US008646376B2

(12) United States Patent
Takeuchi et al.

(10) Patent No.: US 8,646,376 B2
(45) Date of Patent: Feb. 11, 2014

(54) DOUBLE RACK AND PINION OSCILLATING DEVICE

(75) Inventors: Kiyoshi Takeuchi, Tsukubamirai (JP); Mitsunori Magaribuchi, Ibaraki (JP); Kazuhiro Shinohara, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 1124 days.

(21) Appl. No.: 12/553,376

(22) Filed: Sep. 3, 2009

(65) Prior Publication Data

US 2010/0064834 A1 Mar. 18, 2010

(30) Foreign Application Priority Data

Sep. 18, 2008 (JP) ..... 2008-239691

(51) Int. Cl.
*F01B 7/04* (2006.01)

(52) U.S. Cl.
USPC ..... 92/68; 92/136; 92/164; 92/168

(58) Field of Classification Search
USPC ..... 92/163, 164, 168, 68, 136; 91/534
See application file for complete search history.

(56) References Cited

U.S. PATENT DOCUMENTS

| | | | | |
|---|---|---|---|---|
| 3,148,595 | A * | 9/1964 | Looney | 92/11 |
| 6,640,689 | B2 * | 11/2003 | Mitsui et al. | 92/68 |
| 2003/0041598 | A1 | 3/2003 | Takeuchi et al. | |

FOREIGN PATENT DOCUMENTS

| | | | |
|---|---|---|---|
| JP | 64-49710 | U | 3/1989 |
| JP | 2-14806 | U | 1/1990 |
| JP | 4-8803 | U | 1/1992 |
| JP | 2537200 | | 3/1997 |
| JP | 2002-310104 | | 10/2002 |

OTHER PUBLICATIONS

Office Action issued Feb. 29, 2012, in Chinese Patent Application No. 200910173904.3 with English translation.
Office Action issued Nov. 13, 2012 in Japanese Application No. 2008-239691 (With English Translation).

* cited by examiner

*Primary Examiner* — Edward Look
*Assistant Examiner* — Michael Quandt
(74) *Attorney, Agent, or Firm* — Oblon, Spivak, McClelland, Maier & Neustadt, L.L.P.

(57) ABSTRACT

A plurality of ring-shaped sealing members are spaced from each other on the outer periphery of each of first and second end caps that seal openings of first and second cylinder holes. Ring-shaped flow paths are formed between adjacent ring-shaped sealing members. Parts of air flow paths that supply and discharge compressed air to and from pressure chambers of the cylinder holes are formed by the ring-shaped flow paths.

12 Claims, 9 Drawing Sheets

DOUBLE RACK AND PINION OSCILLATING DEVICE

BACKGROUND OF THE INVENTION

1. Field of the Invention

The present invention relates to a double rack and pinion oscillating device, and more specifically, it relates to an oscillating device in which a pair of racks arranged parallel to each other are caused to linearly reciprocate by pistons in opposite directions relative to each other, and an output shaft is thereby caused to rotationally oscillate through a pinion meshed with both the racks.

2. Description of the Related Art

Hitherto, a double rack and pinion oscillating device has been commonly known that includes a pair of pistons having racks arranged parallel to each other, an output shaft having a pinion meshed with both the racks, and supported rotatably around its axis, and in which the pair of pistons are caused to linearly reciprocate in opposite directions relative to each other by fluid pressure, and the output shaft is thereby caused to rotationally oscillate.

In such an oscillating device, when a pair of pistons are caused to linearly reciprocate in opposite directions relative to each other, pressure fluid needs to be alternately supplied to a pressure chamber at one end of one piston and a pressure chamber at the other end of the other piston, and a pressure chamber at the other end of one piston and a pressure chamber at one end of the other piston. However, due to structural and manufacturing limitations, flow paths connecting the pressure chambers can need to be formed so as to straddle the cylinder hole of each piston.

In conventional oscillating devices, as disclosed in the patent documents, Japanese Registered Utility Model No. 2537200 and Japanese Unexamined Patent Application Publication No. 2002-310104, the flow paths are formed by forming flow path grooves in an end plate, or separately preparing a plate in which flow path grooves are formed.

However, in such conventional oscillating devices, it is necessary not only to form complexly-shaped flow path grooves in the surface of a plate but also to prepare complexly-shaped sealing members surrounding the complex flow path grooves, and therefore there is room for improvement in terms of structure and cost.

BRIEF SUMMARY OF INVENTION

The present invention is intended to solve such a problem. A technical object of the present invention is to make it possible to form flow paths that supply pressure fluid to pressure chambers in a double rack and pinion oscillating device more easily and at low cost.

To solve the above problem, in an aspect of the present invention, a double rack and pinion oscillating device includes a body having a first end and a second end on the side opposite thereto; a first cylinder hole and a second cylinder hole arranged in the body so as to extend from the first end to the second end parallel to each other; a first piston and a second piston that slide in the first and second cylinder holes, respectively; racks provided in the pistons; an output shaft having a pinion meshing with the racks; first pressure chambers formed on the first end side of the first and second cylinder holes by the first and second pistons: second pressure chambers formed on the second end side of the first and second cylinder holes by the first and second pistons; a first air flow path connecting the second pressure chamber of the first cylinder hole and the first pressure chamber of the second cylinder hole; and a second air flow path connecting the first pressure chamber of the first cylinder hole and the second pressure chamber of the second cylinder hole, the first and second pistons being driven synchronously in opposite directions relative to each other by compressed air supplied to the first air flow path and the second air flow path, and the output shaft being thereby rotationally oscillated around its axis. A first opening and a second opening of the first cylinder hole and the second cylinder hole that open at the first end of the body are sealed by a first end cap and a second end cap. On the outer periphery of each of the first end cap and the second end cap, a plurality of ring-shaped sealing members are spaced at intervals in the axial direction of the end cap, and ring-shaped flow paths are formed between adjacent ring-shaped sealing members. Part of the first air flow path is formed by the ring-shaped flow path of the first end cap, and part of the second air flow path is formed by the ring-shaped flow path of the second end cap.

In the double rack and pinion oscillating device according to the present invention, it is preferable that the first air flow path include a first main flow path that connects the second pressure chamber of the first cylinder hole to the first opening, the ring-shaped flow path of the first end cap that communicates with the first main flow path in the first opening, and a first connecting flow path that communicates with the ring-shaped flow path in the first opening and connects the first opening to the first pressure chamber of the second cylinder hole, and the second air flow path include a second main flow path that connects the second pressure chamber of the second cylinder hole to the second opening, the ring-shaped flow path of the second end cap that communicates with the second main flow path in the second opening, and a second connecting flow path that communicates with the ring-shaped flow path in the second opening and connects the second opening to the first pressure chamber of the first cylinder hole.

In a preferred embodiment of the oscillating device according to the present invention, the end caps each have at least three ring-shaped sealing members, and first ring-shaped flow paths communicating with the main flow paths and second ring-shaped flow paths having through holes communicating with the first pressure chambers of the cylinder holes are formed between adjacent ring-shaped sealing members. A first communication hole passing through the body and connecting the first ring-shaped flow path of the first end cap and the second ring-shaped flow path of the second end cap, and a second communication hole passing through the body and connecting the first ring-shaped flow path of the second end cap and the second ring-shaped flow path of the first end cap are provided between the first opening and the second opening. The first connecting flow path is formed by the first communication hole, and the second ring-shaped flow path and the through hole provided in the second end cap, and the second connecting flow path is formed by the second communication hole, and the second ring-shaped flow path and the through hole provided in the first end cap.

In an oscillating device according to an embodiment of the present invention, it is preferable that three ring-shaped grooves in which the ring-shaped sealing members are fitted, and two ring-shaped convex portions located between the ring-shaped grooves be formed on the outer periphery of each of the end caps, ring-shaped spaces be formed between the outer peripheral surfaces of the ring-shaped convex portions and the inner peripheral surface of each of the openings, and the ring-shaped flow paths be formed by these ring-shaped spaces.

The end caps may have recesses communicating with the first pressure chambers of the cylinder holes, and the through holes of the second ring-shaped flow paths may communicate with the recesses. The first ring-shaped flow path of the first end cap and the second ring-shaped flow path of the second end cap may be arranged so as to face each other, the second ring-shaped flow path of the first end cap and the first ring-shaped flow path of the second end cap may be arranged so as to face each other, and the first communication hole and the second communication hole may be arranged parallel to each other.

In another preferred embodiment of the oscillating device according to the present invention, the end caps each have at least two ring-shaped sealing members, and the ring-shaped flow paths are formed between adjacent ring-shaped sealing members. Between the first opening and the first pressure chamber of the second cylinder hole, a first communication hole passing through the body and connecting the ring-shaped flow path of the first end cap and the first pressure chamber is provided. Between the second opening and the first pressure chamber of the first cylinder hole, a second communication hole passing through the body and connecting the ring-shaped flow path of the second end cap and the first pressure chamber is provided. The first connecting flow path and the second connecting flow path are formed by the first communication hole and the second communication hole, respectively.

In an oscillating device according to another embodiment of the present invention, it is preferable that three ring-shaped grooves be formed on the outer periphery of each of the end caps, the ring-shaped sealing members be fitted in the ring-shaped grooves located at both ends in the axial direction of the end caps, and the ring-shaped flow paths be formed by the ring-shaped grooves located in the middle in the axial direction of the end caps.

In the above double rack and pinion oscillating device according to the present invention, a plurality of ring-shaped sealing members are spaced from each other on the outer periphery of each of first and second end caps that seal openings of first and second cylinder holes, ring-shaped flow paths are formed between adjacent ring-shaped sealing members, and parts of air flow paths that supply compressed air to pressure chambers of the cylinder holes are formed by the ring-shaped flow paths. Therefore, air flow paths can be formed relatively easily, and the production cost can be reduced.

BRIEF DESCRIPTION OF DRAWINGS

FIG. 7 is a schematic transverse sectional view showing the internal structure of a double rack and pinion oscillating device according to a second embodiment of the present invention.

DETAILED DESCRIPTION OF INVENTION

Figure 1:
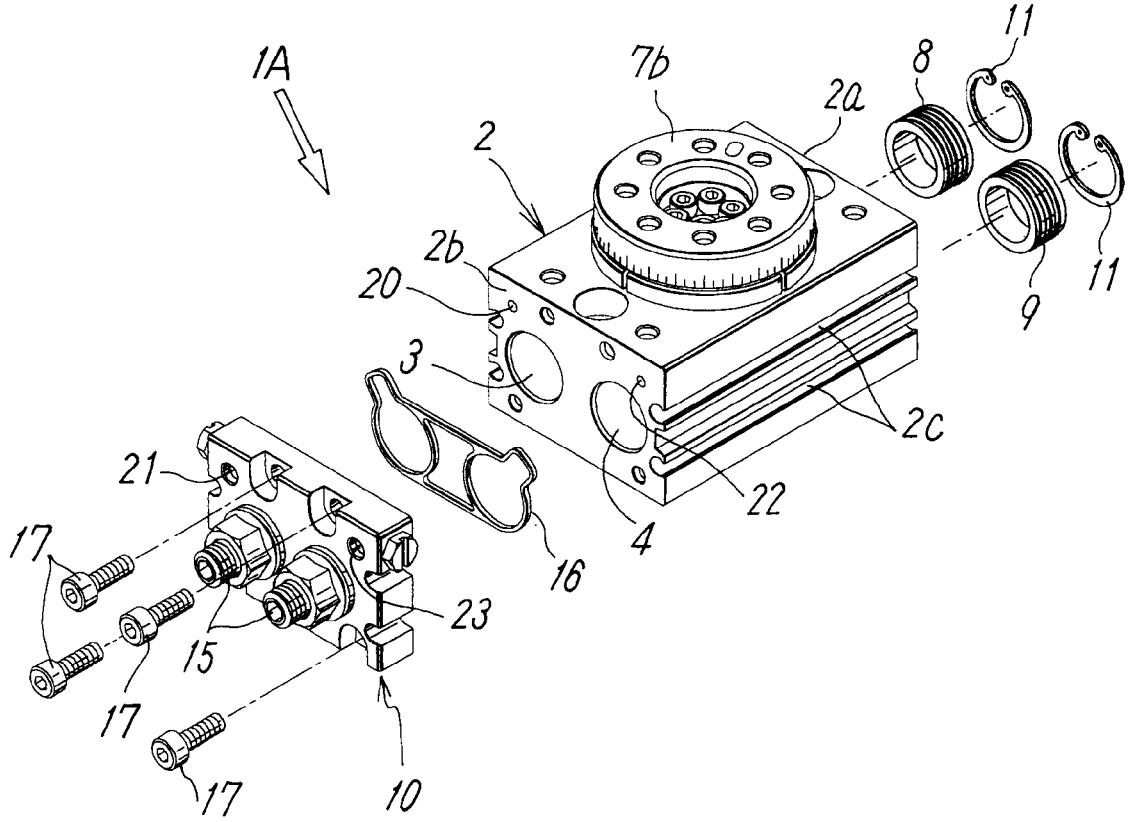
FIG. 1 is a perspective view showing the appearance of a double rack and pinion oscillating device according to a first embodiment of the present invention.

Embodiments of a double rack and pinion oscillating device according to the present invention will now be described with reference to FIGS. 1 to 13.

FIGS. 1 to 4 show a double rack and pinion oscillating device 1A according to a first embodiment of the present invention.

This double rack and pinion oscillating device 1A generally includes a body 2 that has a first end 2*a* and a second end 2*b* in the longitudinal direction (axial direction), a first cylinder hole 3 and a second cylinder hole 4 that extend in the body 2 from the first end 2*a* to the second end 2*b* parallel to each other, a first piston 5 and a second piston 6 that are slidably placed in the first and second cylinder holes 3 and 4, respectively, and have toothed racks 5*a* and 6*a* at positions facing each other in their sides, an output shaft 7 that is supported at a position between the pistons 5 and 6 in the body 2 rotatably around an axis perpendicular to the axes of the pistons 5 and 6 and to which a pinion 7*a* meshing with the racks 5*a* and 6*a* is attached, a first end cap 8 and a second end cap 9 that seal openings of the first and second cylinder holes 3 and 4 on the first end 2*a* side, and an end plate 10 that seals openings of the cylinder holes 3 and 4 on the second end 2*b* side. The first and second pistons 5 and 6 are caused to linearly reciprocate synchronously in opposite directions relative to each other by compressed air, and the output shaft 7 is thereby rotationally oscillated.

The body 2 is integrally formed substantially in a rectangular solid shape by extruding a metal material such as aluminum. Between the first end 2*a* and the second end 2*b* thereof, the first and second cylinder holes 3 and 4 are provided. The insides of the first cylinder holes 3 and 4 are divided into first pressure chambers 3*a* and 4*a* on the first end 2*a* side of the body 2 and second pressure chambers 3*b* and 4*b* on the second end 2*b* side of the body 2. In openings of the first and second cylinder holes 3 and 4 on the first end 2*a* side, a first opening 3*c* and a second opening 4*c* are formed that are larger in diameter than parts where the first and second pistons 5 and 6 slide. In these openings 3*c* and 4*c*, the end caps 8 and 9 are fitted in an airtight manner. These end caps 8 and 9 are held so as not to come off, by C-shaped rings 11, 11 that are engaged with and fixed to the inner walls of the openings 3*c* and 4*c*. In both side surfaces of the body 2, sensor attaching grooves 2*c* for attaching sensors (not shown) that detect the positions of the pistons 5 and 6 are formed parallel to the cylinder holes 3 and 4.

The first and second pistons 5 and 6 are each integrally molded in a solid substantially cylindrical shape. At each end in the axial direction of each piston, a lip-shaped ring-shaped sealing member 12 formed of an elastic body and a wear ring 13 formed of resin are adjacently provided, and the first pressure chambers 3*a* and 4*a* and the second pressure chambers 3*b* and 4*b* are thereby kept airtight. In the middle parts between the ring-shaped wear rings 13, 13 in the pistons 5 and 6, the pair of racks 5*a* and 6*a* are provided so as to face each other, and magnets 14 are attached. By detecting these magnets 14 with sensors attached to the sensor attaching grooves 2*c*, the positions of the pistons 5 and 6 are detected.

The output shaft 7 is rotatably supported by a bearing (not shown) in a shaft hole 2*d* that extending through the middle of the body 2 in a direction perpendicular to the axes of the cylinder holes 3 and 4. The output shaft 7 has the pinion 7*a* at one end thereof and has a table 7*b* coaxially fixed to the other end thereof. The table 7*b* is placed on the top of the body 2 and is configured to rotationally oscillate together with the output shaft 7.

The end plate 10 includes a plate main body 10*a* integrally molded substantially in the same shape and size as the end face of the second end 2*b* of the body 2, and two adjusters 15, 15 for adjusting the reciprocating range of the pistons 5 and 6 and thereby adjusting the angle of rotational oscillation of the output shaft 7. At positions near the first and second cylinder holes 3 and 4 in the plate main body 10*a*, first and second ports 21 and 23 are provided that are connected to a pressure source through a solenoid valve (not shown), for example, and supply and discharge compressed air to and from the first and second pressure chambers 3*a*, 3*b*, 4*a*, and 4*b* of the cylinder holes 3 and 4. The end plate 10 is fixed to the end face of the second end 2*b* of the body 2 with a sealing member 16 therebetween by a plurality of fixing bolts 17 serving as fixing means. The end plate 10 hermetically seals the openings of the cylinder holes 3 and 4 on the second end 2*b* side of the body 2.

The adjusters 15 each includes an adjusting bolt 15*a*, a cushion pad 15*b*, and an adjusting nut 15*c*. The adjusting bolt 15*a* has a male thread on the outer peripheral surface, is screwed into a screw hole of the end plate 10, and thereby passes through the end plate 10 in an airtight manner. The front ends of the adjusting bolts 15*a* are placed in the second pressure chambers 3*b* and 4*b* of the cylinder holes 3 and 4. The cushion pad 15*b* is provided on the front end face of the adjusting bolt 15*a* and is formed of an elastic body. The adjusting nut 15*c* is attached to the adjusting bolt 15*a* on the outer side of the end plate 10.

By screwing the adjusting bolts 15*a* in the axial direction and adjusting the amount of projection of the adjusting bolts 15*a* into the second pressure chambers 3*b* and 4*b*, the reciprocating ranges of the pistons 5 and 6 can be adjusted. By the cushion pads 15*b*, the shock of the impact of the end faces of the pistons 5 and 6 against the adjusters 15 can be absorbed.

The oscillating device 1A further includes a first air flow path 20 that connects the second pressure chamber 3*b* of the first cylinder hole 3 and the first pressure chamber 4*a* of the second cylinder hole 4, and a second air flow path 22 that connects the first pressure chamber 3*a* of the first cylinder hole 3 and the second pressure chamber 4*b* of the second cylinder hole 4. The first and second ports 21 and 23 are connected to the first and second air flow paths 20 and 22, respectively. By supplying and discharging compressed air through these ports 21 and 23, the first and second pistons 5 and 6 are caused to reciprocate synchronously in opposite directions relative to each other in the first and second cylinder holes 3 and 4, respectively, and the output shaft 7 and the table 7*b* are caused to rotationally oscillated.

Figure 3:
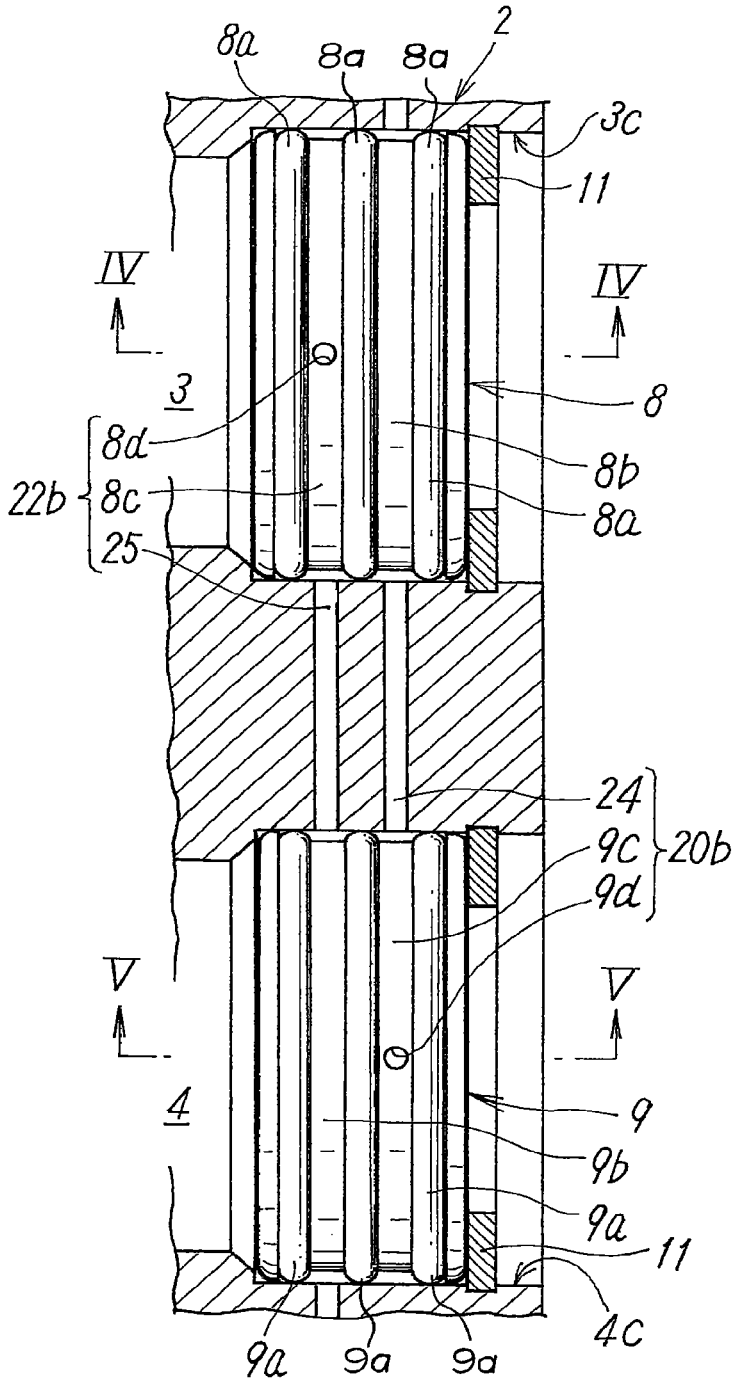
FIG. 3 is an enlarged view of the essential parts of FIG. 2.
Figure 4:
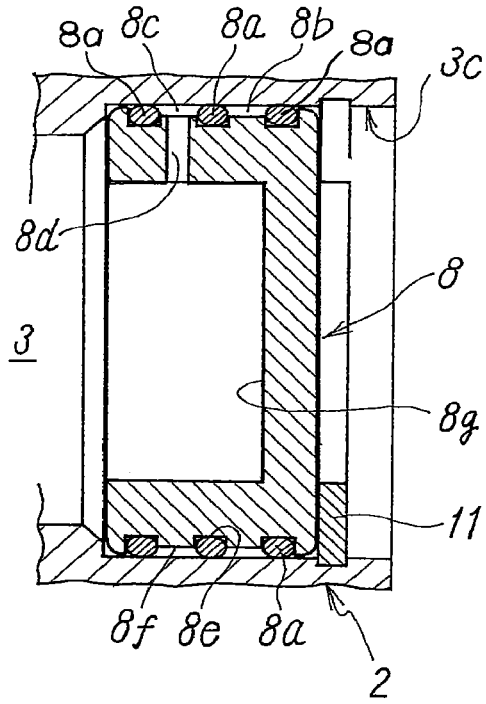
FIG. 4 is a sectional view taken along line IV-IV of FIG. 3.
Figure 5:
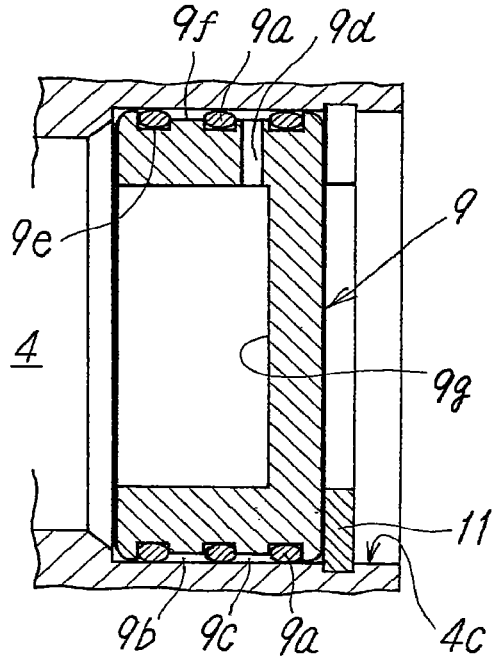
FIG. 5 is a sectional view taken along line V-V of FIG. 3.
Figure 6:
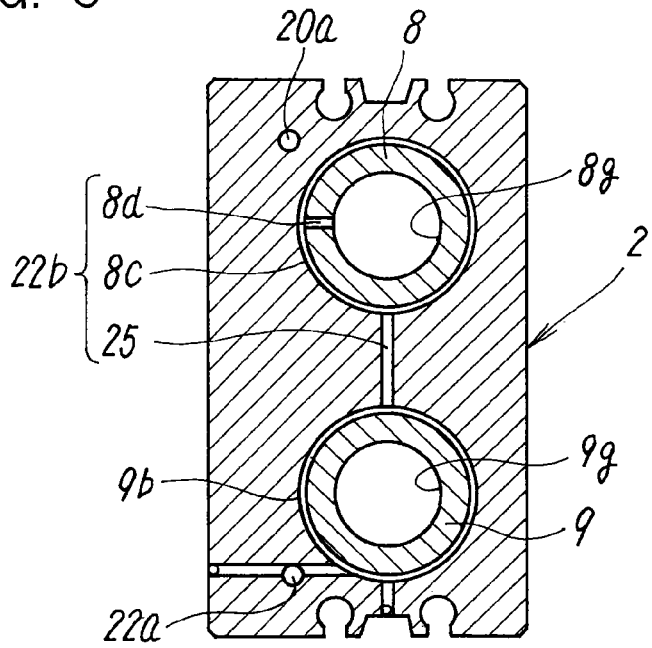
FIG. 6 is a sectional view taken along line VI-VI of FIG. 2.
Figure 7:
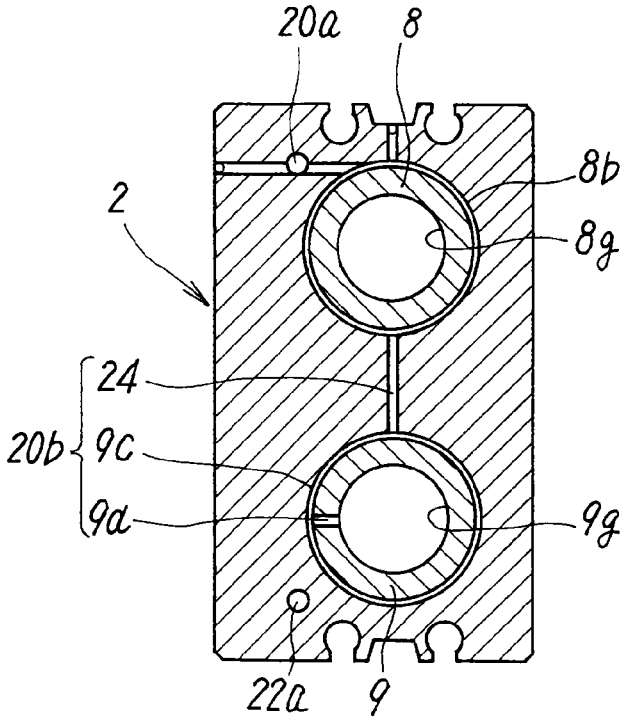
FIG. 7 is a sectional view taken along line VII-VII of FIG. 2.
Figure 8:
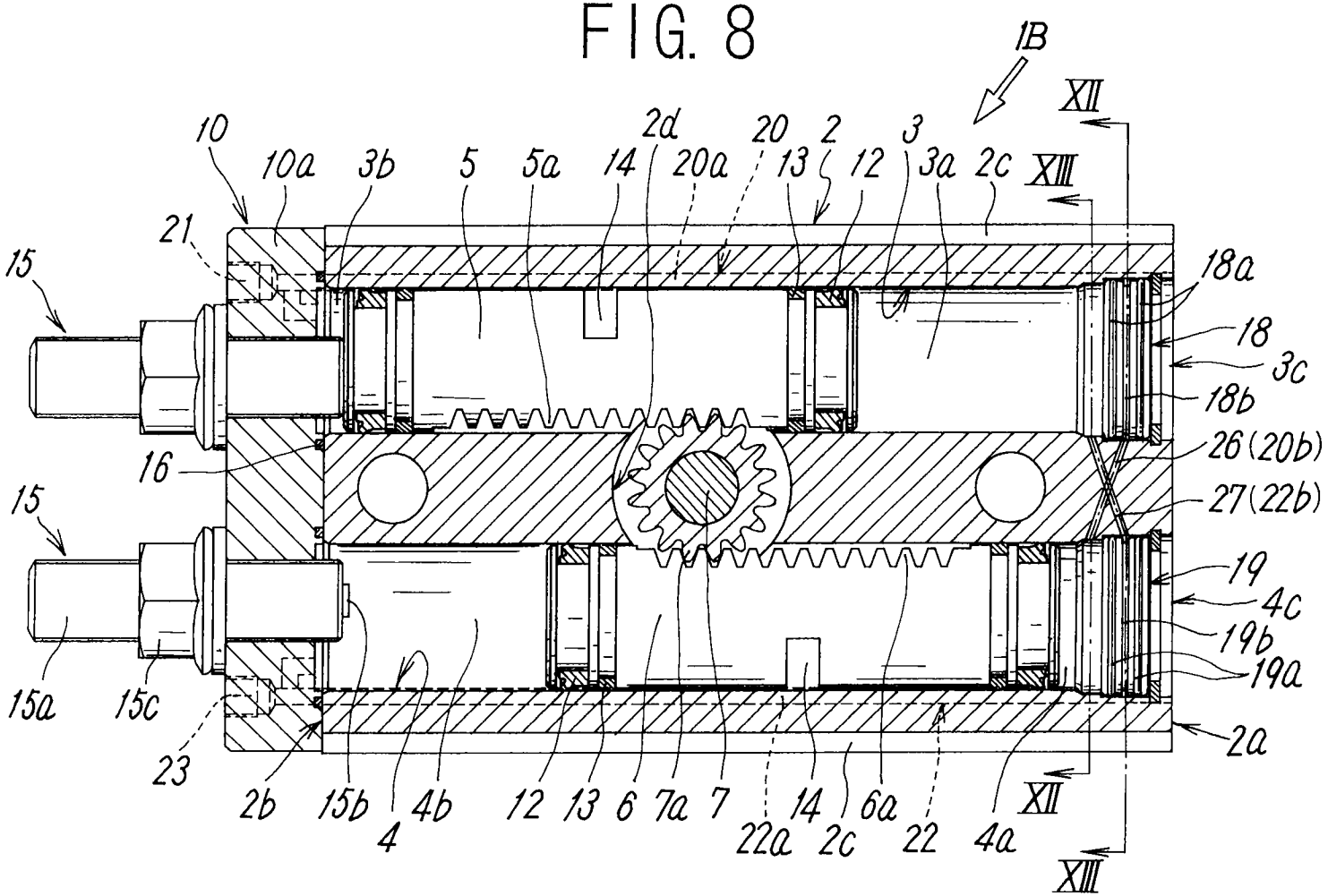

In the first embodiment, the end caps 8 and 9 each have three ring-shaped sealing members 8*a*, 9*a* as shown in FIGS. 3 to 5. The ring-shaped sealing members 8*a*, 9*a* are placed on the outer periphery around the axis of each of the end caps 8 and 9, are spaced at intervals in the axial direction, and are formed of an elastic body. Between these adjacent ring-shaped sealing members 8*a*, 9*a*, a first ring-shaped flow path 8*b*, 9*b* and a second ring-shaped flow path 8*c*, 9*c* are formed. The first end cap 8 is provided with a through hole 8*d* (FIG. 6) that connects the second ring-shaped flow path 8*c* of the first end cap 8 and the first pressure chamber 3*a* of the first cylinder hole 3. The second end cap 9 is provided with a through hole 9*d* (FIG. 7) that connects the second ring-shaped flow path 9*c* of the second end cap 9 and the first pressure chamber 4*a* of the second cylinder hole 4.

More specifically, three ring-shaped grooves 8*e*, 9*e* and two ring-shaped convex portions 8*f*, 9*f* are formed on the outer periphery of each of the end caps 8 and 9. The ring-shaped sealing members 8*a*, 9*a* are fitted in the ring-shaped grooves 8*e*, 9*e*. The ring-shaped convex portions 8*f*, 9*f* are located between adjacent ring-shaped grooves 8*e*, 9*e* and have a diameter smaller than the maximum diameter of the end caps 8 and 9. When the end caps 8 and 9 are fitted in the openings 3*c* and 4*c*, respectively, ring-shaped spaces are formed between the outer peripheral surfaces of the ring-shaped convex portions 8*f*, 9*f* and the inner peripheral surface of each of the openings 3*c* and 4*c*. By these ring-shaped spaces, the first ring-shaped flow paths 8*b* and 9*b* and the second ring-shaped flow paths 8*c* and 9*c* are formed.

The first ring-shaped flow path 8*b* and the second ring-shaped flow path 8*c* of the first end cap 8 and the first ring-shaped flow path 9*b* and the second ring-shaped flow path 9*c* of the second end cap 9 are arranged alternately. So, the first ring-shaped flow path 8*b* of the first end cap 8 and the second ring-shaped flow path 9*c* of the second end cap 9 are arranged opposite each other, and the second ring-shaped flow path 8*c* of the first end cap 8 and the first ring-shaped flow path 9*b* of the second end cap 9 are arranged opposite each other.

The end caps 8 and 9 further have recesses 8*g* and 9*g*, respectively, the openings of which face the first pressure chambers 3*a* and 4*a* of the cylinder holes 3 and 4. The through holes 8*d* and 9*d* extend in the radial direction between the outer peripheral surfaces of the ring-shaped convex portions 8*f* and 9*f*, respectively, that form the second ring-shaped flow paths 8*c* and 9*c*, respectively, and the recesses 8*g* and 9*g*, respectively.

In the first embodiment, the first and second end caps 8 and 9 are formed in the same shape and size except for the positions of the through holes 8*d* and 9*d*.

As described below in detail, the oscillating device 1A uses the first and second end caps 8 and 9 having the above-described structure, instead of a conventional plate having complexly-shaped flow path grooves formed in the surface, and parts of the first and second air flow paths 20 and 22 are formed by the ring-shaped flow paths 8*b*, 8*c*, 9*b*, and 9*c*.

That is, the first air flow path 20 includes a first main flow path 20*a* that connects the second pressure chamber 3*b* of the first cylinder hole 3 and the first opening 3*c* of the first cylinder hole 3, the first ring-shaped flow path 8*b* of the first end cap 8 that is connected to the first main flow path 20*a* in the first opening 3*c*, and a first connecting flow path 20*b* that is connected to the first ring-shaped flow path 8*b* in the first opening 3*c* and connects the first opening 3*c* and the first pressure chamber 4*a* of the second cylinder hole 4.

The first main flow path 20*a* extends along the first cylinder hole 3 in the body 2 and in the plate main body 10*a* of the end plate 10 and is connected to the first port 21 in the plate main body 10*a*.

The first connecting flow path 20*b* is formed by a first communication hole 24, and the second ring-shaped flow path 9*c* and the through hole 9*d* in the second end cap 9. The first communication hole 24 passes through the inside of the body 2 and connects the first ring-shaped flow path 8*b* of the first end cap 8 and the second ring-shaped flow path 9*c* of the second end cap 9 between the first and second openings 3*c* and 4*c*.

The second air flow path 22 includes a second main flow path 22*a* that connects the second pressure chamber 4*b* of the second cylinder hole 4 and the second opening 4*c* of the second cylinder hole 4, the first ring-shaped flow path 9*b* of the second end cap 9 that is connected to the second main flow path 22*a* in the second opening 4*c*, and a second connecting flow path 22*b* that is connected to the first ring-shaped flow path 9*b* in the second opening 4*c* and connects the second opening 4*c* and the first pressure chamber 3*a* of the first cylinder hole 3.

The second main flow path 22*a* extends along the second cylinder hole 4 in the body 2 and in the plate main body 10*a* of the end plate 10 and is connected to the second port 23 in the plate main body 10*a*.

The second connecting flow path 22*b* is formed by a second communication hole 25, and the second ring-shaped flow path 8*c* and the through hole 8*d* in the first end cap 8. The second communication hole 25 passes through the inside of the body 2 and connects the first ring-shaped flow path 9*b* of the second end cap 9 and the second ring-shaped flow path 8*c* of the first end cap 8 between the first and second openings 3*c* and 4*c*.

As described above, in the oscillating device 1A according to the first embodiment, the first ring-shaped flow path 8*b* and the second ring-shaped flow path 8*c* of the first end cap 8 and the first ring-shaped flow path 9*b* and the second ring-shaped flow path 9*c* of the second end cap 9 are arranged alternately, and therefore the first communication hole 24 and the second communication hole 25 are arranged parallel to each other. However, the positional relationship between the first and second ring-shaped flow paths 8*b* and 8*c* of the first end cap 8 and the first and second ring-shaped flow path 9*b* and 9*c* of the second end cap 9 is not limited to the shown one.

Next, the operation of the oscillating device 1A having the above-described structure will be described.

Figure 2:
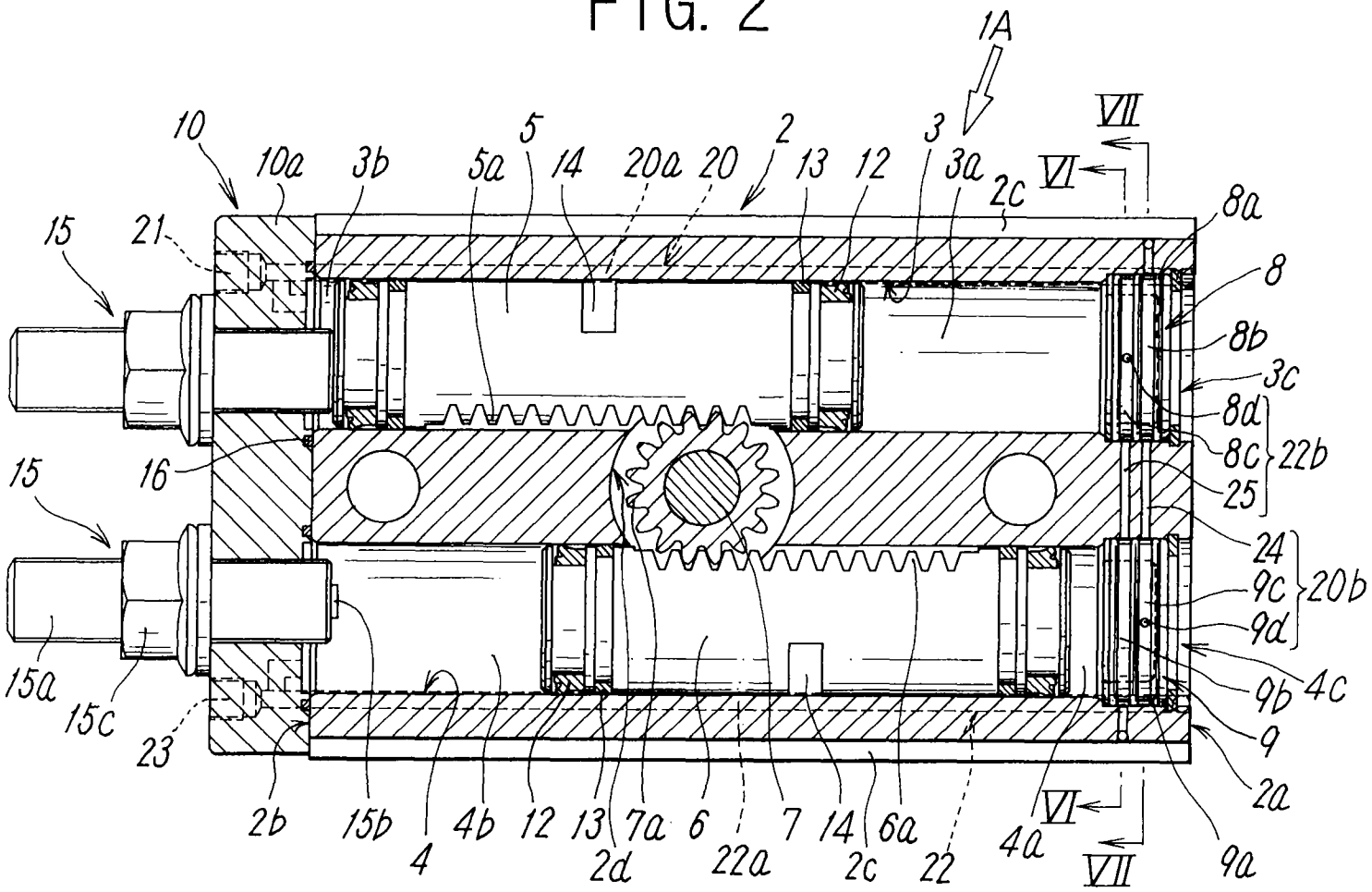
FIG. 2 is a schematic transverse sectional view showing the internal structure of a double rack and pinion oscillating device according to a first embodiment of the present invention.

First, in the state of FIG. 2, compressed air is supplied through the first port 21. The compressed air is supplied through the first main flow path 20*a* to the second pressure chamber 3*b* of the first cylinder hole 3. At the same time, the compressed air is supplied through the first main flow path 20*a*, the first ring-shaped flow path 8*b* of the first end cap 8, the first connecting flow path 20*b* (that is, the first communication hole 24, and the second ring-shaped flow path 9*c* and the through hole 9*d* in the second end cap 9), and the recess 9*g* of the second end cap 9 to the first pressure chamber 4*a* of the second cylinder hole 4.

The first piston 5 is driven in the first cylinder hole 3 toward the first end 2*a* of the body 2, and the second piston 6 is driven in the second cylinder hole 4 toward the second end 2*b* of the body 2 until the second piston 6 comes into contact with the adjuster 15. At the same time, the output shaft 7 rotates clockwise around its axis by a predetermined angle. At that time, the air in the first pressure chamber 3*a* of the first cylinder hole 3 and the second pressure chamber 4*b* of the second cylinder hole 4 is discharged through the second air flow path 22 and the second port 23 to the atmosphere.

Next, in this state, compressed air is supplied through the second port 23. The compressed air is supplied through the second main flow path 22*a* to the second pressure chamber 4*b* of the second cylinder hole 4. At the same time, the compressed air is supplied through the second main flow path 22*a*, the first ring-shaped flow path 9*b* of the second end cap 9, the second connecting flow path (that is, the second communication hole 25, and the second ring-shaped flow path 8*c* and the through hole 8*d* in the first end cap 8), and the recess 8*g* of the first end cap 8 to the first pressure chamber 3*a* of the first cylinder hole 3.

The first piston 5 is driven in the first cylinder hole 3 toward the second end 2*b* of the body 2 until the first piston 5 comes into contact with the adjuster 15 (the state of FIG. 2), and the second piston 6 is driven in the second cylinder hole 4 toward the first end 2*a* of the body 2. At the same time, the output shaft 7 rotates counter-clockwise around its axis by a predetermined angle. At that time, the air in the second pressure chamber 3*b* of the first cylinder hole 3 and the first pressure chamber 4*a* of the second cylinder hole 4 is discharged through the first air flow path 20 and the first port 21 to the atmosphere.

By repeating the above-described operations, the output shaft 7 can be rotationally oscillated.

As described above, in the oscillating device 1A according to the first embodiment, a plurality of ring-shaped sealing members 8*a*, 9*a* are spaced from each other on the outer periphery of each of first and second end caps 8 and 9 that seal the openings of the first and second cylinder holes 3 and 4, ring-shaped flow paths 8*b*, 8*c*, 9*b*, 9*c* are formed between adjacent ring-shaped sealing members 8*a*, 9*a*, and parts of air flow paths 20 and 22 that supply and discharge compressed air to and from pressure chambers 3*a*, 3*b*, 4*a*, and 4*b* of the first and second cylinder holes 3 and 4 are formed by the ring-shaped flow paths. Therefore, ail flow paths 20 and 22 can be relatively easily formed. As a result, the production cost can be reduced.

In the first embodiment, the end caps 8 and 9 each have three ring-shaped sealing members 8*a*, 9*a*. However, the number of the ring-shaped sealing members may be four or more. That is, the end caps 8 and 9 each have at least three ring-shaped sealing members 8*a*, 9*a*, and the first and second ring-shaped flow paths are formed between adjacent ring-shaped sealing members.

FIGS. 8 to 13 show a double rack and pinion oscillating device 1B according to a second embodiment of the present invention.

A description will be given mainly of differences from the first embodiment. The same reference numerals will be used to designate the same components as those in the first embodiment, and redundant description will be omitted.

The oscillating device 1B according to the second embodiment differs from the oscillating device 1A according to the first embodiment mainly in the structure of the first and second end caps and the structure of the first and second connecting flow paths.

Figure 9:
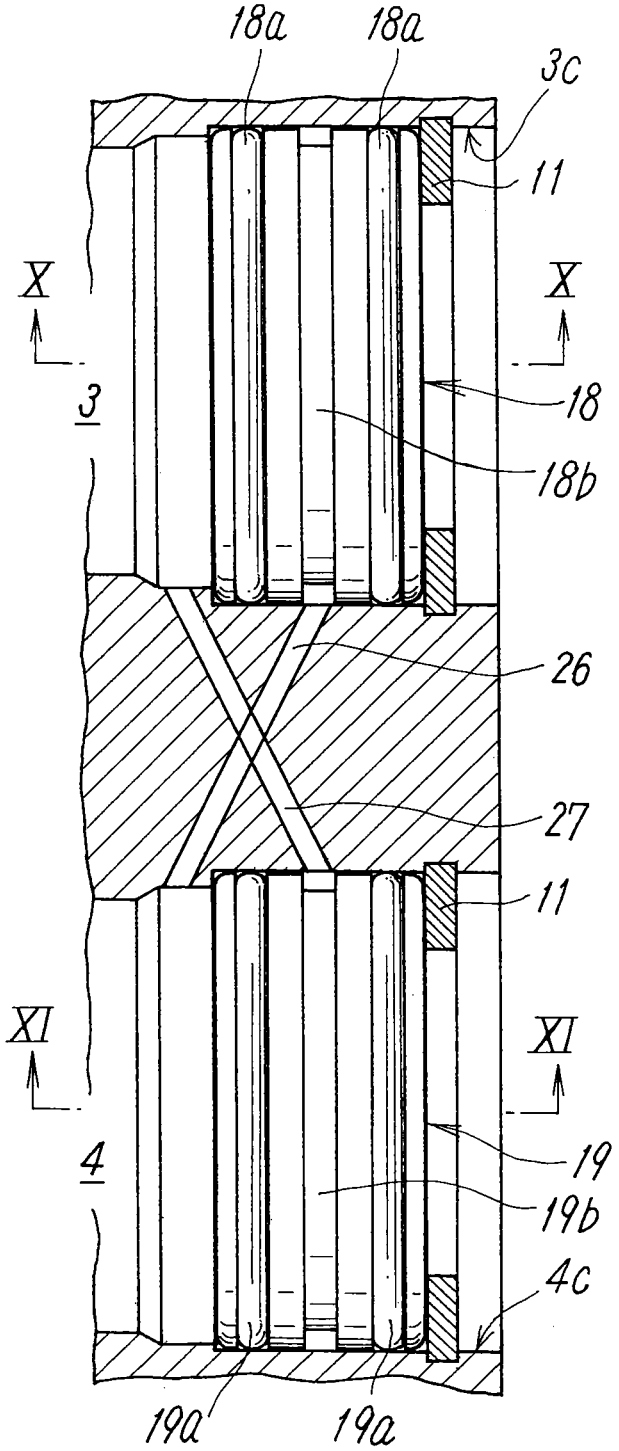
FIG. 9 is an enlarged view of the essential parts of FIG. 8.
Figure 10:
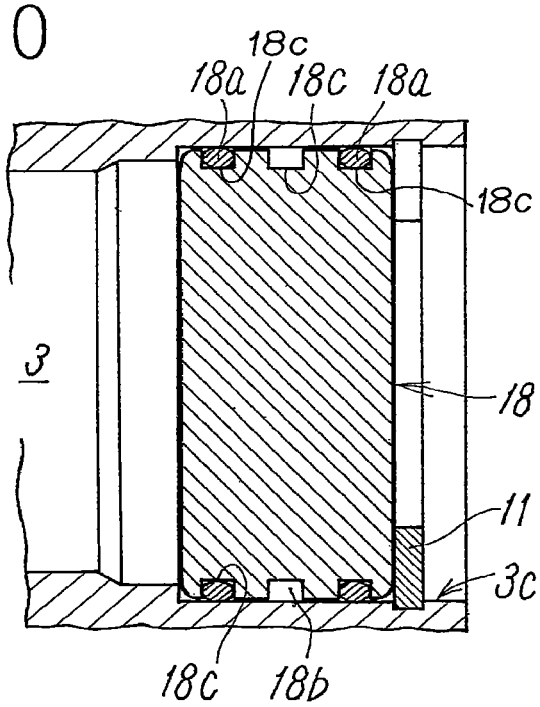
FIG. 10 is a sectional view taken along line X-X of FIG. 9.
Figure 11:
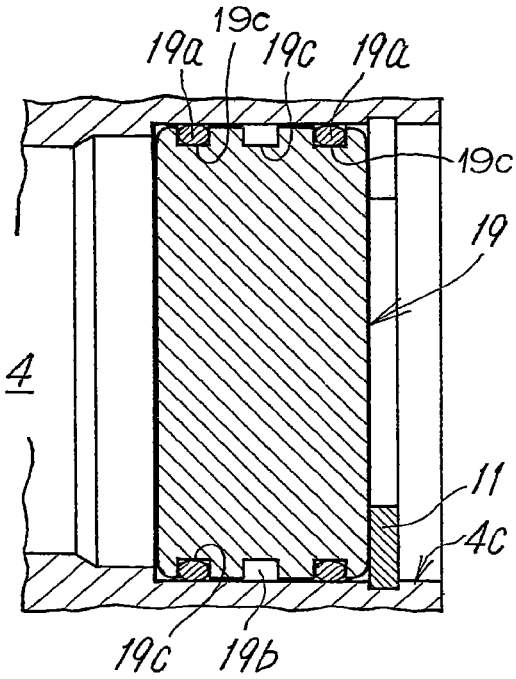
FIG. 11 is a sectional view taken along line XI-XI of FIG. 9.
Figure 12:
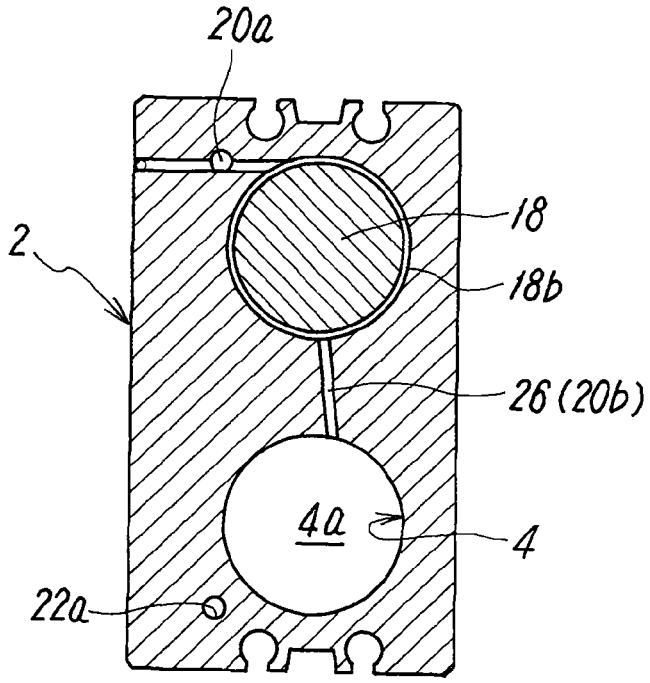
FIG. 12 is a sectional view taken along line XII-XII of FIG. 8.
Figure 13:
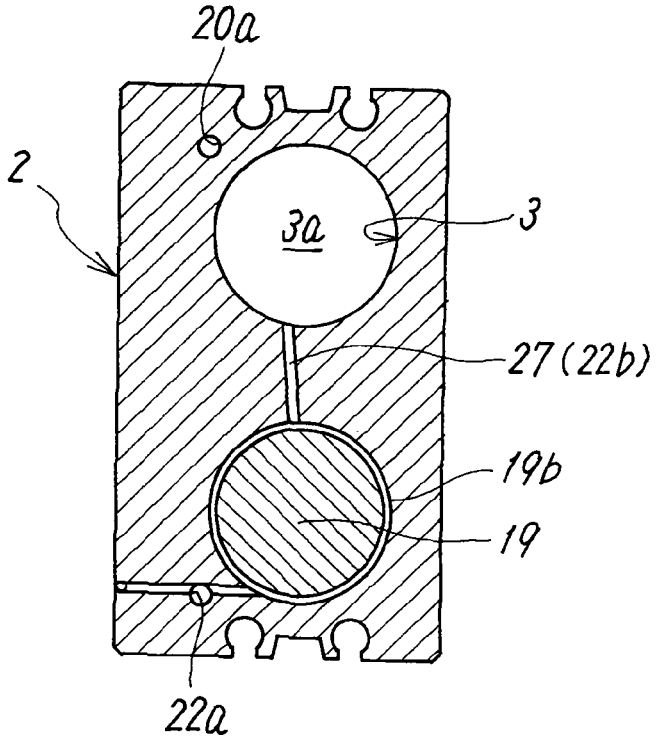
FIG. 13 is a sectional view taken along line XIII-XIII of FIG. 8.

The first and second end caps 18 and 19 in the second embodiment are formed in the same shape and size as shown in FIGS. 9 to 11 and each have two ring-shaped sealing members 18*a*, 19*a*. The ring-shaped sealing members 18*a*, 19*a* are placed on the outer periphery around the axis of each of the end caps 18 and 19, are spaced at intervals in the axial direction, and are formed of an elastic body. Between these ring-shaped sealing members 18*a*, 19*a*, ring-shaped flow paths 18*b*, 19*b* are formed.

More specifically, three ring-shaped grooves 18*c*, 19*c* are formed on the outer periphery of each of the end caps 18 and 19 substantially at regular intervals in the axial direction. The ring-shaped sealing members 18*a*, 19*a* are fitted in the ring-shaped grooves 18*c*, 19*c* located at both ends in the axial direction. The ring-shaped flow paths 18*b* and 19*b* are formed by the ring-shaped grooves 18*c*, 19*c* located in the middle of the end caps in the axial direction. That is, when the end caps 18 and 19 are fitted in the first and second openings 3*c* and 4*c* of the cylinder holes 3 and 4, the ring-shaped flow paths 18*b* and 19*b* are formed by ring-shaped spaces surrounded by the ring-shaped grooves 18*c*, 19*c* located in the middle in the axial direction and the inner peripheral surface of each of the openings 3*c* and 4*c*.

As described below in detail, the oscillating device 1B uses the first and second end caps 18 and 19 having the above-described structure, and parts of the first and second air flow paths 20 and 22 are formed by the ring-shaped flow paths 18*b* and 19*b*, respectively.

That is, the first air flow path 20 includes a first main flow path 20*a* that connects the second pressure chamber 3*b* of the first cylinder hole 3 and the first opening 3*c* of the first cylinder hole 3, the ring-shaped flow path 18*b* of the first end cap 18 that is connected to the first main flow path 20*a* in the first opening 3*c*, and a first connecting flow path 20*b* that is connected to the ring-shaped flow path 18*b* in the first opening 3*c* and connects the first opening 3*c* and the first pressure chamber 4*a* of the second cylinder hole 4.

The first connecting flow path 20*b* is formed by a first communication hole 26 that passes through the inside of the body 2 and directly connects the ring-shaped flow path 18*b* of the first end cap 18 and the first pressure chamber 4*a* of the second cylinder hole 4, between the first opening 3*c* and 4*c* and the first pressure chamber 4*a* of the second cylinder hole 4.

The second air flow path 22 includes a second main flow path 22*a* that connects the second pressure chamber 4*b* of the second cylinder hole 4 and the second opening 4*c* of the second cylinder hole 4, the ring-shaped flow path 19*b* of the second end cap 19 that is connected to the second main flow path 22*a* in the second opening 4*c*, and a second connecting flow path 22*b* that is connected to the ring-shaped flow path 19*b* in the second opening 4*c* and connects the second opening 4*c* and the first pressure chamber 3*a* of the first cylinder hole 3.

The second connecting flow path 22*b* is formed by a second communication hole 27 that passes through the inside of the body 2 and directly connects the ring-shaped flow path 19*b* of the second end cap 19 and the first pressure chamber 3*a* of the first cylinder hole 3, between the second opening 4*c* and the first pressure chamber 3*a* of the first cylinder hole 3.

The connecting flow paths 20*b* and 22*b*, that is, the communication holes 26 and 27 open at positions near the end caps 19 and 18 in the first pressure chambers 4*a* and 3*a*. The diameter of the cylinder holes 3 and 4 at the opening positions is larger than the diameter of parts where the pistons 5 and 6 slide, and is smaller than the diameter of the openings 3*c* and 4*c*. The first and second communication holes 26 and 27 are angled so as not to intersect with each other in the body 2.

The operation of the oscillating device 1B according to the second embodiment is basically the same as the first embodiment, and so the description thereof will be omitted.

As described above, also in the oscillating device 1B according to the second embodiment, as in the case of the first embodiment, a ring-shaped flow path 18*b*, 19*b* is formed on the outer periphery around the axis of each of end caps 18 and 19, the ring-shaped flow paths 18*b* and 19*b* form parts of the air flow paths 20 and 22, and air flow paths 20 and 22 can thereby be relatively easily formed. As a result, the production cost can be reduced. In addition, since the first and second end caps 18 and 19 are identical components and the air flow paths 20 and 22 can have simpler structure, the cost can be further reduced.

In the second embodiment, the end caps 18 and 19 each have two ring-shaped sealing members 18*a*, 19*a*. However, the number of the ring-shaped sealing members may be three or more. That is, the end caps 18 and 19 each have at least two ring-shaped sealing members 18*a*, 19*a*, and the ring-shaped flow paths are formed between adjacent ring-shaped sealing members.

The invention claimed is:

1. A double rack and pinion oscillating device comprising:

a body having a first end and a second end on the side opposite thereto;

a first cylinder hole and a second cylinder hole arranged in the body so as to extend from the first end to the second end parallel to each other;

a first piston and a second piston that slide in the first and second cylinder holes, respectively;

racks provided in the pistons;

an output shaft having a pinion meshing with the racks;

first pressure chambers formed on the first end side of the first and second cylinder holes by the first and second pistons;

second pressure chambers formed on the second end side of the first and second cylinder holes by the first and second pistons;

a first air flow path connecting the second pressure chamber of the first cylinder hole and the first pressure chamber of the second cylinder hole; and a second air flow path connecting the first pressure chamber of the first cylinder hole and the second pressure chamber of the second cylinder hole, the first and second pistons being driven synchronously in opposite directions relative to each other by compressed air supplied to the first air flow path and the second air flow path, and the output shaft being thereby rotationally oscillated around its axis, wherein a first opening of one end of the first cylinder hole and a second opening of one end of the second cylinder hole open at the first end of the body and are sealed by a first end cap and a second end cap, and a third opening of the other end of the first cylinder hole and a fourth opening of the other end of the second cylinder hole open at the second end of the body and are sealed by an end plate, wherein a first port connecting to the first flow path, a second port connecting to the second flow path, and adjusters are provided in the end plate, tips of the adjusters protruding into the second pressure chambers of the first cylinder hole and the second cylinder hole, respectively, wherein on an outer periphery of each of the first end cap and the second end cap, a plurality of ring-shaped sealing members are spaced at intervals in the axial direction of the end cap, and ring-shaped flow paths are formed between adjacent ring-shaped sealing members, and wherein part of the first air flow path is formed by the ring-shaped flow path of the first end cap, and part of the second air flow path is formed by the ring-shaped flow path of the second end cap.

2. The double rack and pinion oscillating device according to claim 1, wherein the first air flow path includes a first main flow path that connects the second pressure chamber of the first cylinder hole to the first opening, the ring-shaped flow path of the first end cap that communicates with the first main flow path in the first opening, and a first connecting flow path that communicates with the ring-shaped flow path in the first opening and connects the first opening to the first pressure chamber of the second cylinder hole, and wherein the second air flow path includes a second main flow path that connects the second pressure chamber of the second cylinder hole to the second opening, the ring-shaped flow path of the second end cap that communicates with the second main flow path in the second opening, and a second connecting flow path that communicates with the ring-shaped flow path in the second opening and connects the second opening to the first pressure chamber of the first cylinder hole.

3. The double rack and pinion oscillating device according to claim 2, wherein the end caps each have at least two ring-shaped sealing members, and the ring-shaped flow paths are formed between adjacent ring-shaped sealing members, wherein between the first opening and the first pressure chamber of the second cylinder hole is provided a first communication hole passing through the body and connecting the ring-shaped flow path of the first end cap and the first pressure chamber of the second cylinder hole, and between the second opening and the first pressure chamber of the first cylinder hole is provided a second communication hole passing through the body and connecting the ring-shaped flow path of the second end cap and the first pressure chamber of the first cylinder hole, and wherein the first connecting flow path and the second connecting flow path are formed by the first communication hole and the second communication hole, respectively.

4. The double rack and pinion oscillating device according to claim 3, wherein three ring-shaped grooves are formed on the outer periphery of each of the end caps, the ring-shaped sealing members are put in the ring-shaped grooves located at both ends in the axial direction of the end caps, and the ring-shaped flow paths are formed by the ring-shaped grooves located in a mid-portion in the axial direction of the end caps.

5. A double rack and pinion oscillating device comprising:

a body having a first end and a second end on the side opposite thereto;

a first cylinder hole and a second cylinder hole arranged in the body so as to extend from the first end to the second end parallel to each other;

a first piston and a second piston that slide in the first and second cylinder holes, respectively;

racks provided in the pistons;

an output shaft having a pinion meshing with the racks;

first pressure chambers formed on the first end side of the first and second cylinder holes by the first and second pistons;

second pressure chambers formed on the second end side of the first and second cylinder holes by the first and second pistons;

a first air flow path connecting the second pressure chamber of the first cylinder hole and the first pressure chamber of the second cylinder hole; and a second air flow path connecting the first pressure chamber of the first cylinder hole and the second pressure chamber of the second cylinder hole, the first and second pistons being driven synchronously in opposite directions relative to each other by compressed air supplied to the first air flow path and the second air flow path, and the output shaft being thereby rotationally oscillated around its axis, wherein a first opening of one end of the first cylinder hole and a second opening of one end of the second cylinder hole open at the first end of the body and are sealed by a first end cap and a second end cap, and a third opening of the other end of the first cylinder hole and a fourth opening of the other end of the second cylinder hole open at the second end of the body and are sealed by an end plate, wherein a first port connecting to the first flow path, a second port connecting to the second flow path, and adjusters are provided in the end plate, tips of the adjusters protruding into the second pressure chambers of the first cylinder hole and the second cylinder hole, respectively, wherein on an outer periphery of each of the first end cap and the second end cap, a plurality of ring-shaped sealing members are spaced at intervals in the axial direction of the end cap, and ring-shaped flow paths are formed between adjacent ring-shaped sealing members, and wherein part of the first air flow path is formed by the ring-shaped flow path of the first end cap, and part of the second air flow path is formed by the ring-shaped flow path of the second end cap, wherein the first air flow path includes a first main flow path that connects the second pressure chamber of the first cylinder hole to the first opening, the ring-shaped flow path of the first end cap that communicates with the first main flow path in the first opening, and a first connecting flow path that communicates with the ring-shaped flow path in the first opening and connects the first opening to the first pressure chamber of the second cylinder hole, and wherein the second air flow path includes a second main flow path that connects the second pressure chamber of the second cylinder hole to the second opening, the ring-shaped flow path of the second end cap that communicates with the second main flow path in the second opening, and a second connecting flow path that communicates with the ring-shaped flow path in the second opening and connects the second opening to the first pressure chamber of the first cylinder hole, wherein the end caps each have at least three ring-shaped sealing members, and wherein a first ring-shaped flow path communicating with one of the first main flow path and the second main flow path, and a second ring-shaped flow path having a through hole communicating with the first pressure chamber of the respective cylinder hole, are formed between adjacent ring-shaped sealing members, wherein a first communication hole passing through the body and connecting the first ring-shaped flow path of the first end cap and the second ring-shaped flow path of the second end cap, and a second communication hole passing through the body and connecting the first ring-shaped flow path of the second end cap and the second ring-shaped flow path of the first end cap are provided between the first opening and the second opening, and wherein the first connecting flow path is formed by the first communication hole, and the second ring-shaped flow path and the through hole provided in the second end cap, and the second connecting flow path is formed by the second communication hole, and the second ring-shaped flow path and the through hole provided in the first end cap.

6. The double rack and pinion oscillating device according to claim 5, wherein three ring-shaped grooves in which the ring-shaped sealing members are fitted, and two ring-shaped convex portions located between the ring-shaped grooves are respectively formed on the outer periphery of each of the end caps, ring-shaped spaces are respectively formed between the outer peripheral surfaces of the ring-shaped convex portions and the inner peripheral surface of each of the openings, and the ring-shaped flow paths are formed by these ring-shaped spaces, respectively.

7. The double rack and pinion oscillating device according to claim 6, wherein the end caps have recesses communicating with the first pressure chambers of the cylinder holes, and the through holes of the second ring-shaped flow paths communicate with the recesses.

8. The double rack and pinion oscillating device according to claim 7, wherein the first ring-shaped flow path of the first end cap and the second ring-shaped flow path of the second end cap are arranged so as to face each other, the second ring-shaped flow path of the first end cap and the first ring-shaped flow path of the second end cap are arranged so as to face each other, and the first communication hole and the second communication hole are arranged parallel to each other.

9. The double rack and pinion oscillating device according to claim 6, wherein the first ring-shaped flow path of the first end cap and the second ring-shaped flow path of the second end cap are arranged so as to face each other, the second ring-shaped flow path of the first end cap and the first ring-shaped flow path of the second end cap are arranged so as to face each other, and the first communication hole and the second communication hole are arranged parallel to each other.

10. The double rack and pinion oscillating device according to claim 5, wherein the end caps have recesses communicating with the first pressure chambers of the cylinder holes, and the through holes of the second ring-shaped flow paths communicate with the recesses.

11. The double rack and pinion oscillating device according to claim 10, wherein the first ring-shaped flow path of the first end cap and the second ring-shaped flow path of the second end cap are arranged so as to face each other, the second ring-shaped flow path of the first end cap and the first ring-shaped flow path of the second end cap are arranged so as to face each other, and the first communication hole and the second communication hole are arranged parallel to each other.

12. The double rack and pinion oscillating device according to claim 5, wherein the first ring-shaped flow path of the first end cap and the second ring-shaped flow path of the second end cap are arranged so as to face each other, the second ring-shaped flow path of the first end cap and the first ring-shaped flow path of the second end cap are arranged so as to face each other, and the first communication hole and the second communication hole are arranged parallel to each other.

* * * * *